US005126620A

United States Patent [19]

Haraga et al.

[11] Patent Number: 5,126,620

[45] Date of Patent: Jun. 30, 1992

[54] DISPLAY ELEMENT

[75] Inventors: Kohsuke Haraga; Shiroh Takatani; Muneharu Sanoh; Kazuo Uesaka; Yoshikazu Ugai; Masaaki Nakano, all of Amagasaki; Naoki Tani; Shunichi Futatsuishi, both of Nagasaki, all of Japan

[73] Assignee: Mitsubishi Denki Kabushiki Kaisha, Japan

[21] Appl. No.: 451,792

[22] Filed: Dec. 18, 1989

[30] Foreign Application Priority Data

Dec. 19, 1988 [JP] Japan ..... 63-321581
Jan. 6, 1989 [JP] Japan ..... 64-1515
Jan. 17, 1989 [JP] Japan ..... 1-8354

[51] Int. Cl.[5] ..... H01J 5/16

[52] U.S. Cl. ..... 313/111; 313/112; 313/496; 359/619

[58] Field of Search ..... 340/766, 702, 796, 782; 350/167, 128, 247, 252; 313/512, 495, 502. 489, 111, 112; 359/619

[56] References Cited

U.S. PATENT DOCUMENTS 2,734,142 2/1956 Barnes ..... 358/252
4,135,112 1/1979 Fisher et al. ..... 313/470
4,451,759 3/1984 Heynisch ..... 313/495
4,667,092 5/1987 Ishihara ..... 350/167
4,887,887 12/1989 Hart ..... 350/252

FOREIGN PATENT DOCUMENTS 0156246 10/1985 European Pat. Off. .

*Primary Examiner*—Alvin E. Oberley
*Assistant Examiner*—Regina Liang
*Attorney, Agent, or Firm*—Leydig, Voit & Mayer

[57] ABSTRACT

A display element includes a position regulating plate along the side of a condensing lens for positioning the sides of the condensing lens, a filter and an emission element in the same plane so as to prevent any deviation in the position. The display element prevents separation between a condensing lens, a filter and the front panel of an emission element even if thermal stress or other external forces are applied to the display element as well as preventing inclination of the condensing lens when the members are bonded together.

15 Claims, 7 Drawing Sheets

DISPLAY ELEMENT

BACKGROUND OF THE INVENTION

1. Field of the Invention

The present invention relates to a display element which forms a light source, for example, for a single cell of an outdoor large-scaled display unit, and particularly to a color display element provided with a condensing lens with a filter.

2. Description of the Related Art

When a large-screen display unit is formed by arranging monochromatic display tubes each utilizing the light emitted from a fluorescent substance and serving as one pixel in the form of a matrix, it is difficult to improve the resolution because of the occurrence of spaces in the connection portions between the respective display tubes, and an increase in the resolution creates an increase in the production cost. For example, the composite display tube for a light source disclosed in Japanese Patent Laid-Open No. 62-10849 has been thus proposed.

FIGS. 1 to 3 are respectively a front view of the basic structure of such a composite display tube for a light source, a sectional view taken along the line II—II in FIG. 1 and a perspective view of a principal portion thereof. In the drawings, fluorescent screens 5R, 5G, 5B each serve as a single pixel and are arranged in a matrix of 3×3 in terms of pixel number. A case 1 comprises a front panel 2 made of a transparent member such as glass, a back panel 3 and a cylindrical side panel 4, the interior being in a vacuum state. Red (R) florescent screens 5R, green (G) fluorescent screens 5G and blue(B) fluorescent screen 5B are arranged in the form of a matrix comprising 3 lines and 3 columns, as shown in FIG. 1, on the back side of the front panel 2. Accelerating electrodes 6 are respectively disposed in the peripheries of the fluorescent screens 5R, 5G and 5B in correspondence with the fluorescent screens. Back electrodes 10 for selecting a line are disposed on the inner side of the back panel 3 in a form with stripes corresponding to the line directions of the fluorescent screens 5R, 5G, 5B. Cathodes 7 are provided above the back electrodes 10 in correspondence with the respective fluorescent screen 5R, 5G, 5B. For example, an indirectly heated cathode in which an oxide is coated on an Ni sleeve, or a directly heated cathode in which an oxide is coated on tungsten is used as each of these cathodes. These cathodes 7 are also supported on the back panel 3 by supporting members 15*a*, 15*b*. Control grids 8 for controlling the columns are disposed between the fluorescent screens 5R, 5G, 5B and the cathodes 7 in a form with stripes corresponding to the column directions. Each of the control grids 8 is provided with holes 9 through which electron beams pass. The electron beams 11 are respectively emitted from the cathodes 7 and applied to the fluorescent screens 5R, 5G, 5B. A high voltage is supplied to each of anodes 6 from a terminal 16. A given voltage is supplied to each of the control grids 8 and the back electrodes 10 from terminal pins 12.

In addition, a filter and a condensing lens are provided on the surface of the front panel 2, as shown in FIGS. 4 and 5, so as to prevent any decrease in the contrast owing to the effect of external light (for example, the sunlight or the like) on the fluorescent screens. In FIGS. 4 and 5, on the front panel 2 are provided a filter 13 comprising color filters 13R, 13G, 13B and a condensing lens 14 disposed on the color filters 13R, 13G, 13B, the condensing lens 14 provided with the filter 13 being bonded to the front panel 2 by an adhesive 18*a*. FIG. 5 shows the case 1 which is mounted on a substrate 17 and which has an interior provided with the cathodes 7, the control grids 8 and the back electrodes 10, which are not shown in the drawing, in the same was as in FIG. 2.

A description will now be given of the operation of the conventional display element. When a negative potential relative to the cathodes 7 is applied to each of the back electrodes 10, since the periphery of each of the cathodes 7 is at a negative potential, the electrons emitted from each of the cathodes 7 do not flow to the control grids 8 and the accelerating anodes 6, thereby bringing the display element into a cut-off state. When a potential of 0 V or a positive potential of several V relative to the cathodes 7 is then applied to the back electrodes 10, the electron beam 11 is emitted from each of the cathodes 7 and flows toward the control grids 8. If the potential of the control grids 8 is negative relative to the cathodes 7, the electron beams 11 respectively cannot pass through the holes 9 and thus cannot reach the accelerating electrodes 6. If the potential of the control grids 8 is positive relative to the cathodes 7, the electron beams respectively pass through the holes 9 and are accelerated by the accelerating electrodes 6 and then applied to the fluorescent screens 5R, 5G, 5B which thus emit light. It is therefore possible to selectively emit light from the fluorescent screens 5R, 5G, 5B, which are disposed at the positions corresponding to the intersections between the back electrodes 10 and the control grids 8 to which voltages are applied by selectively applying a given voltage to the back electrodes 10 for selecting a line in the arrangement of the fluorescent screen 5R, 5G, 5B and the control grids for selecting a column. Further, if a large number of such display elements each serving as one cell are arranged to form a large screen, it is possible to form a color display comprising the fluorescent screens 5R, 5G, 5B each serving as a pixel.

The conventional display element configured as described above has a problem in that, when the filter 13 and the condensing lens 14 are bonded to the surface of the front panel 2 by using the adhesive 18*a*, the bonding work cannot be easily performed in such a manner that the positions of the color filters 13R, 13G, 13B and the condensing lens 14 respectively agree with the positions of the fluorescent screens 5R, 5G, 5B, and thus easily produces deviations in the positions.

SUMMARY OF THE INVENTION

The present invention has been achieved with a view to resolving the above-described problem, and it is an object of the present invention to provide a display element which allows the filter lens 13 and the condensing lens 14 to be fixed by adhesion to the front panel 2 without producing any deviation in the positions thereof.

A display element in accordance with the present invention is provided with a position regulating plate for regulating the sides of the filter and the condensing lens so that they are placed on the same plane as the side of the front panel.

The position regulating plate of the present invention is capable of regulating the filter and the condensing lens to a given position and thus facilitating the bonding work.

An object of the further embodiments. A embodiment of the invention is to provides structure of a display element which is capable of preventing the separation of the condensing lens from the filter and the case even if thermal stress or other external force is applied to the display element, and further which is capable of preventing the occurrence of an inclination in the condensing lens during the bonding. Another object of this invention is to provide embodiment a structure of a display element which makes the filter unnecessary by imparting filter characteristics to the condensing lens by coloring it. This application further contains a method of producing such display elements.

DESCRIPTION OF THE PREFERRED EMBODIMENTS

Figure 4:
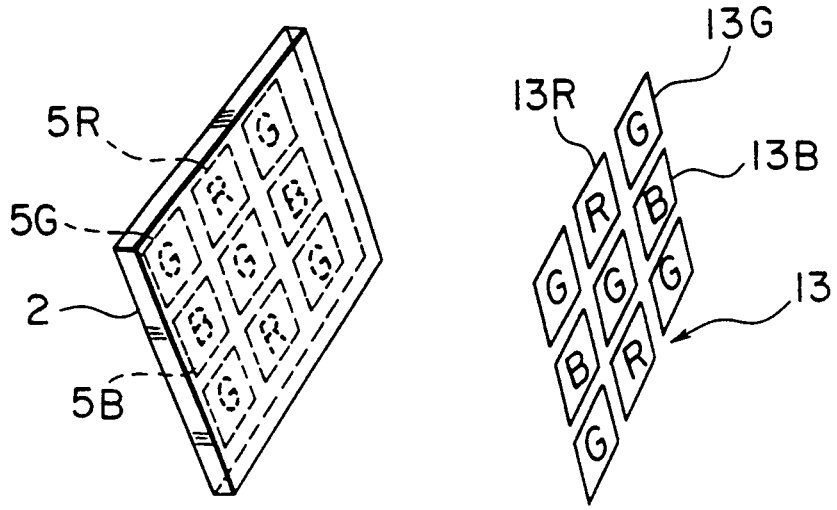
FIG. 4 PRIOR ART
FIG. 4 is a perspective view which shows the positional relationship of a filter to the fluorescent screens of the front panel shown in FIG. 1.
Figure 5:
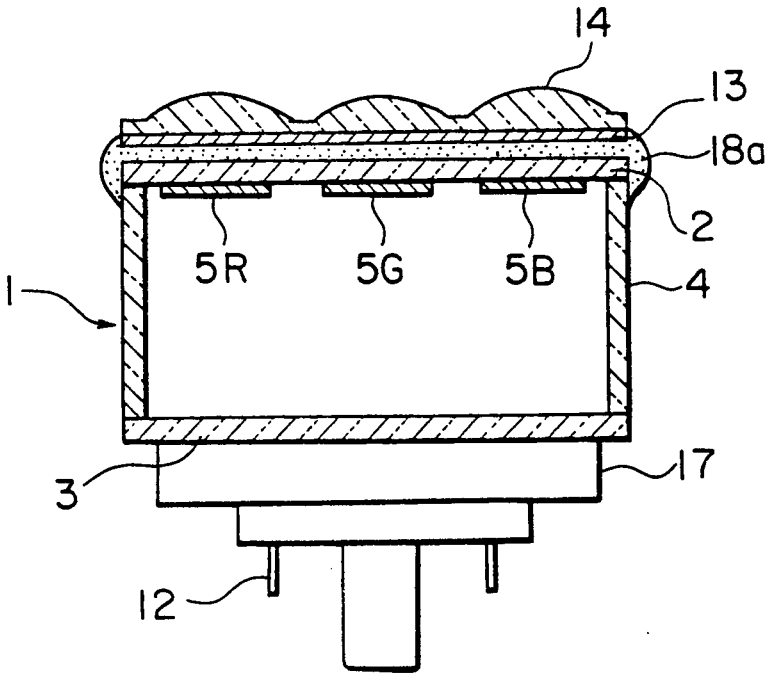
FIG. 5 PRIOR ART
FIG. 5 is a sectional side view of a principal portion in a state wherein the case shown in FIG. 2 is provided with a filter and a condensing lens.
Figure 6:
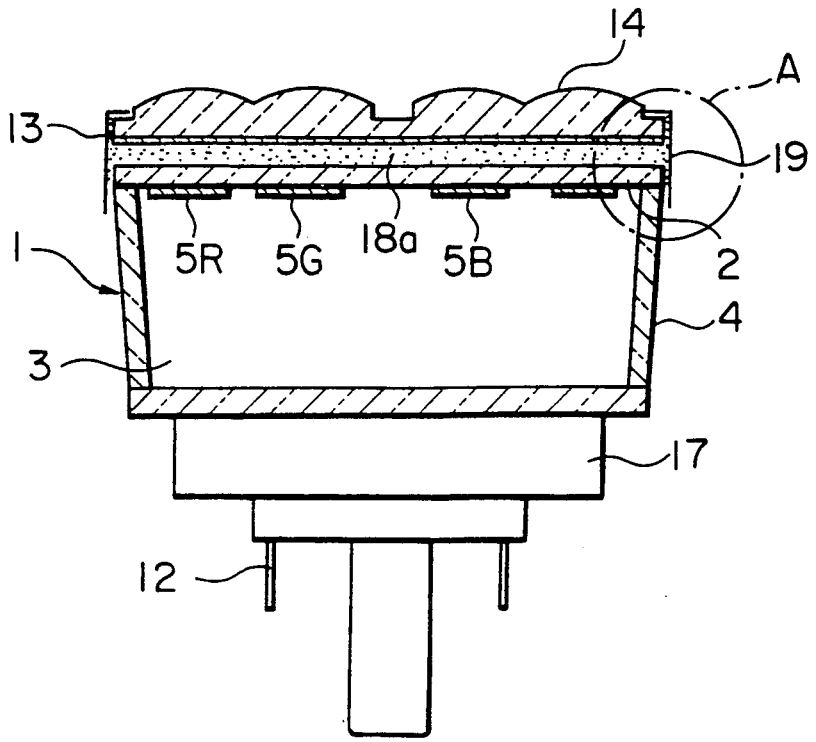
FIG. 6 is a sectional side view of a display element in an embodiment of the invention.
Figure 6A:
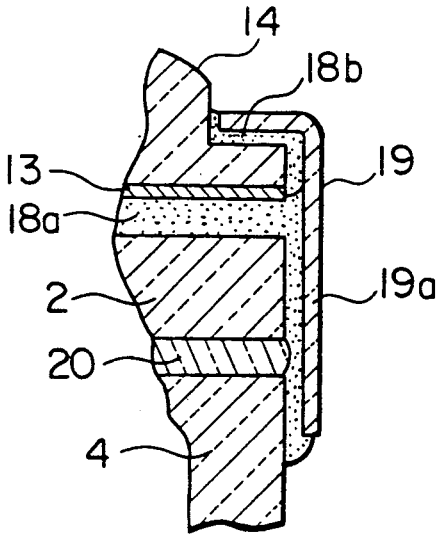
FIG. 6A is an enlarged sectional view of the portion A surrounded by a dashed line in FIG. 6.
Figure 7:
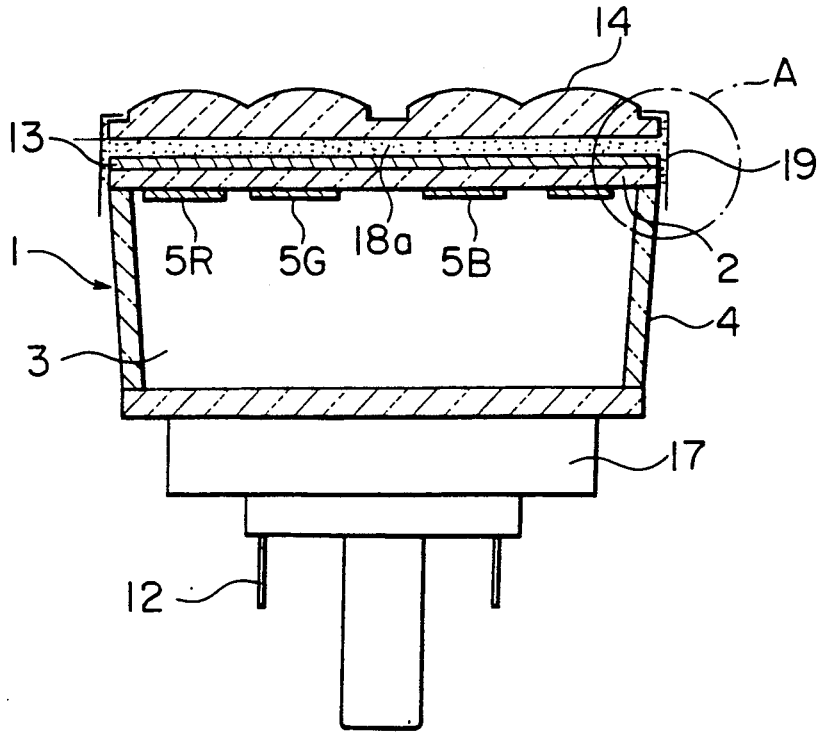
FIG. 7 is a sectional side view of a display element in another embodiment of the invention.

An embodiment of the invention will be described below with reference to the drawings. In FIGS. 6, 6A and 7, the portions corresponding to those shown in FIG. 5 are denoted by the same reference numerals and are not described below. Although the interior of the case 1 is not shown in the drawings, the cathodes 7, the control grids 8 and the back electrodes 10 are provided therein in the same way as in FIG. 4. In FIGS. 6 and 6A, a position regulating plate 19 has a hook-shaped sectional form, as shown in the drawings, and is bonded to the peripheral portion and the side of the condensing lens 14 through a transparent adhesive 18*b* (the same as the adhesive 18*a*), as well as being extended from the side of the front panel 2 to an upper portion of the side panel 4, an extended portion 19*a* being bonded to the front panel 2 and the side panel 4 through the adhesive 18*a*. The front panel 2 and the side panel 4 are bonded together by an adhesive 20.

The operation of this display element will be described below. When the filter 13 and the condensing lens 14 are bonded to the front panel 2, the position regulating plate 19 is first bonded to the peripheral portion and the side of the condensing lens 14 by using the adhesive 18*b*. The filter 13 and the condensing lens 14 to which the position regulating plate 19 is bonded are then mounted on the surface of the front panel 2 and bonded thereto by the adhesive 18*a*. At this time, the extended portion 19*a* of the position regulating plate 19 is pressed against the side of the front panel 2 and the upper portion of the side panel 4 so that the sides of the filter 13 and the condensing lens 14 are positioned on substantially the same plane as the sides of the front panel and the side panel 4. That is, these side ends are arranged on the same line. At the same time, the positions of the color filters 13R, 13G, 13B and the condensing lens 14 respectively agree with the fluorescent screens 5R, 5G, 5B opposite thereto, and the filter and the condensing lens 14 are held at the positions without becoming loose. The adhesive 18*b* does not unnecessarily rise and an excess adhesive 18*b* downwardly flows along the side of the side panel 4. When the adhesive 18*b* is dried, the filter 13 and the condensing lens 14 are respectively fixed by adhesion at the proper positions.

In the above-mentioned embodiment, although the condensing lens 14 provided with the filter 13 and the position regulating plate 19 are separately formed, the position regulating plate 19 may be formed integrally with the condensing lens 14. In this case, the adhesive 18*b* is made unnecessary.

Alternatively, the filter 13 and the condensing lens 14 may be bonded together by the adhesive 18*a* and the position regulating plate 19 may be then mounted on them. In this case, the adhesive 18*b* is made unnecessary.

Although the filter 13 is mounted (or bonded) on the inner side of the condensing lens 14 in the above-described display, this invention can be applied to a structure in which the filter 13 directly mounted (or bonded) on the front panel 2 of the display, and the condensing lens 14 is bonded to the filter 13 by the adhesive 18*a*, as shown in FIG. 7. In this case, the same effect as that described above can be exhibited.

As described above, in the embodiment, when the condensing lens and the front panel of the case are combined by using the adhesive with the filter therebetween, the position regulating plate which extends from the peripheral edge of the condensing lens to the side thereof and to the upper portion of the side of the case and which has a hook-shaped sectional form is provided or it is provided integrally with the condensing lens. The embodiment thus enables the formation of a display element which exhibits a high level of precision without producing any mutual deviation in the positions thereof and facilitates the bonding work and which allows the position regulating plate to serve as a protection cover for protecting the four corners of the case and the condensing lens from shocks and the like. The position regulating plate is also capable of preventing rain water and dust particles from entering into the portions between the condensing lens, the filter and the case.

On the other hand, in the conventional display element shown in FIG. 5, separation easily occurs between the condensing lens 14, the filter 13, the transparent adhesive 18*a* and the case 1 on the basis of the occurrence of a curve in the condensing lens caused by differences between the coefficients of thermal expansion produced owing to a temperature change during the use. This applies to the structure in which the filter 13 is mounted on the case 1 and the condensing lens 14 is bonded to the filter 13 by the transparent adhesive 18*a* as shown in FIG. 7. For example, when the adhesive 18*a* is cured while the condensing lens 14 is elastically deformed by the load applied during junction, a stress occurs between the condensing lens 14 and the adhesive 18*a*, resulting in the occurrence of separation. Further, it is difficult to join the face of the condensing lens 14 and the face of the case 11 in parallel with each other.

The occurrence of such separation causes a decrease in luminance owing to the reflection of light from the separated surface and causes the loss of the colors owing to the total reflection from the separated surface when the display element is seen at an angle. There is also a problem in that, if the condensing lens 14 is inclined, the optical characteristics are impaired.

The second embodiment of the thus provides the structure of a display element which is capable of preventing the occurrence of separation between the condensing lens and the case for receiving the filter and the emission element and which produces no inclination of the lens during junction.

Figure 1:
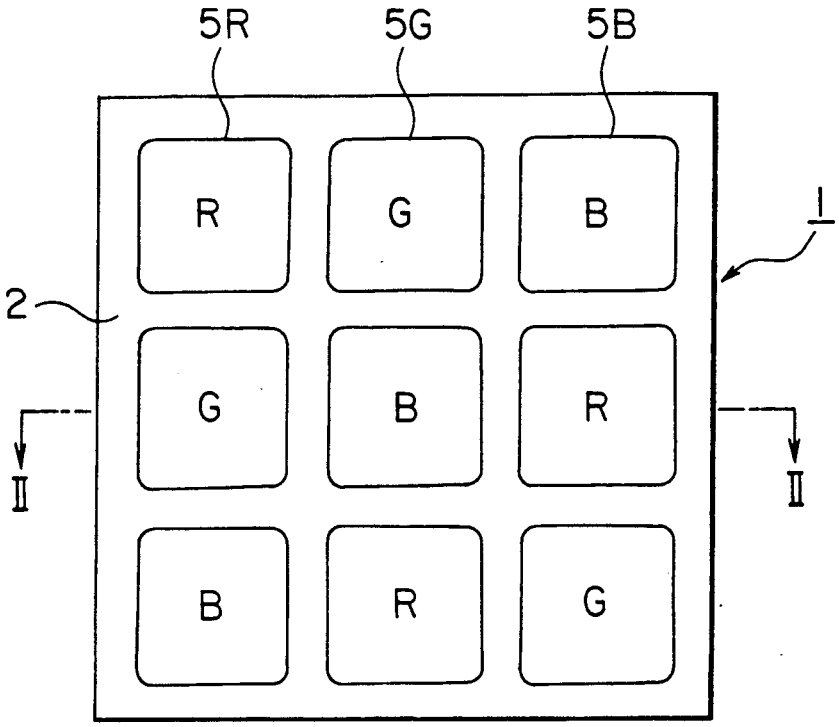
FIG. 1 PRIOR ART
FIG. 1 is a plan view of a conventional display element.
Figure 2:
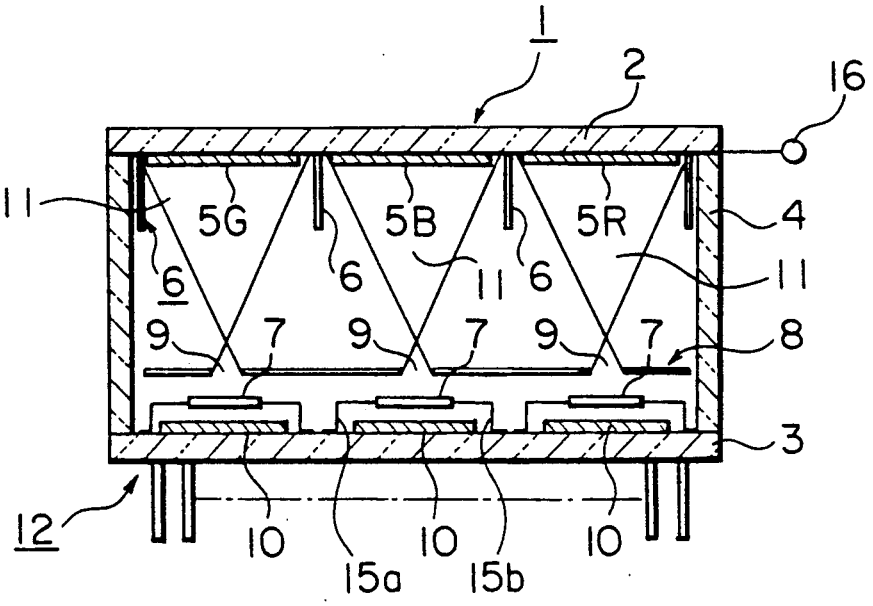
FIG. 2 PRIOR ART
FIG. 2 is a sectional view taken along the line II—II in FIG. 1.
Figure 3:
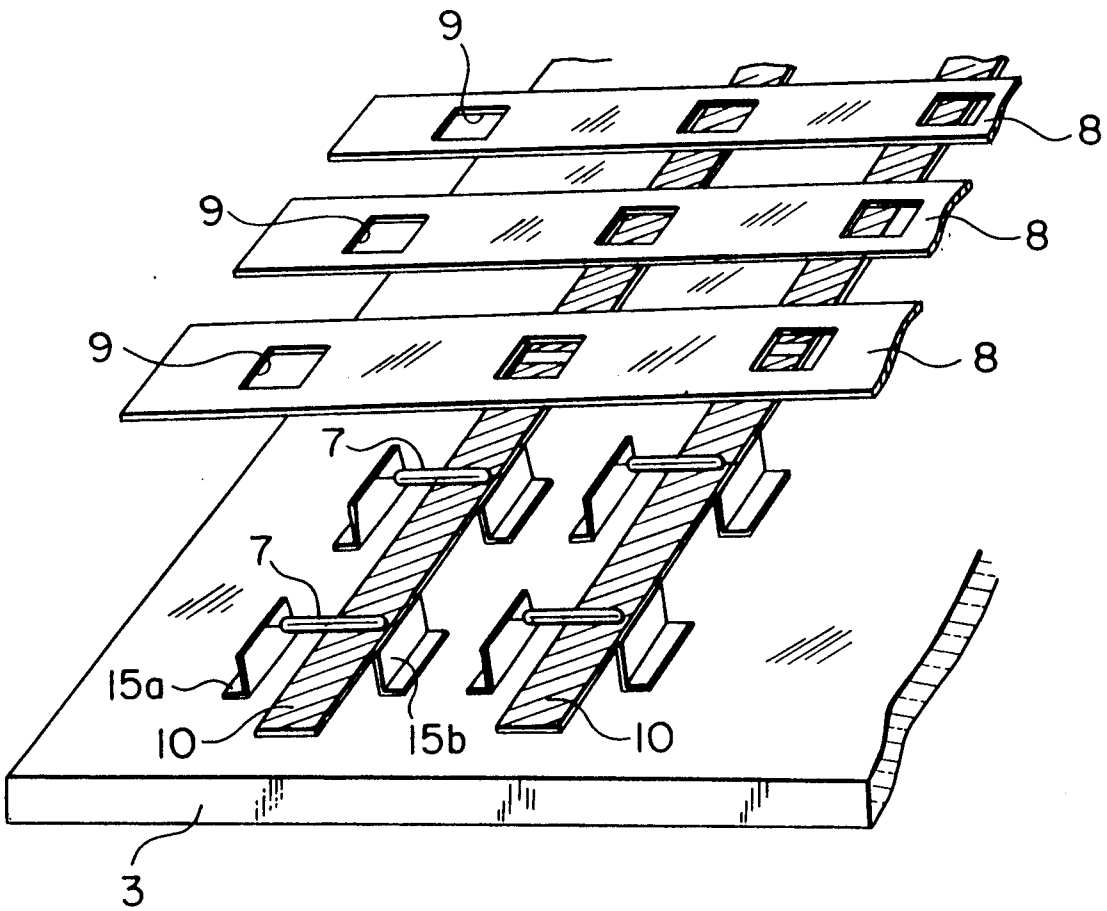
FIG. 3 PRIOR ART
FIG. 3 is an exploded perspective view of a principal portion of the display element shown in FIG. 2.
Figure 8:
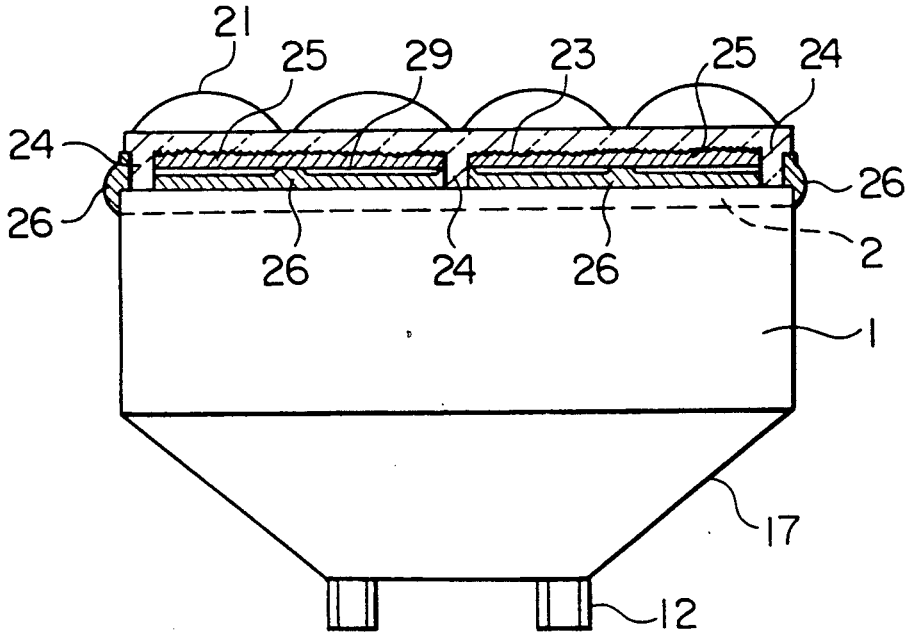
FIG. 8 is a partially sectional side view of a display element in further embodiment of the second invention.
Figure 9:
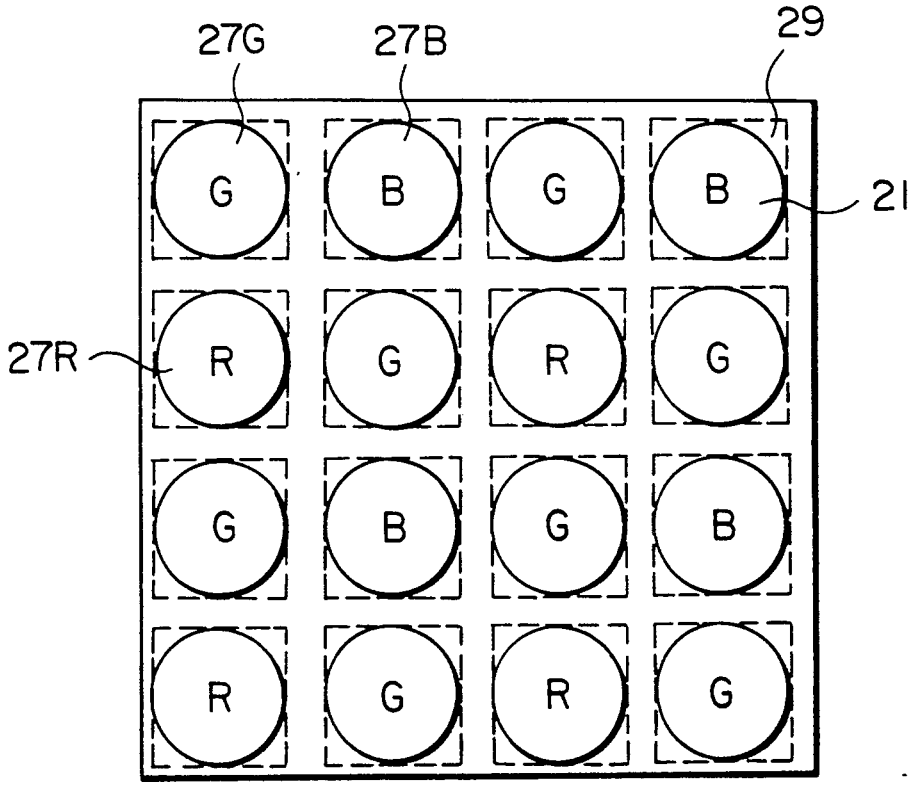
FIG. 9 is a front view of the display element shown in FIG. 8.

FIGS. 8 and 9 are a side view and a front view, respectively, the second embodiment, the upper portion of FIG. 8 being a sectional view. In the drawings, on the front panel 2 of a case 1, which receives an emission element (not shown) and which is made of a transparent member such as glass, are provided a filter 29 for cutting off external light, which is formed by curing a material composed of ultraviolet curing silicone resin as a main component, and a condensing lens 21 made of heat resistant acrylic resin for condensing light transmitted through the filter and emitted from the emission element (refer to FIG. 2) received in the case 1. The rear side 23 of the condensing lens 21 is roughened, and at least three projections 24 are provided thereon. The fine unevenness of the roughened rear side 23 of the condensing lens 21 causes an increase in the adhesive area of the rear side of the condensing lens 21 and exhibits an anchor effect. Each of the projections 24 serves to uniform the distance between the condensing lens 21 and the front panel 2. A resin layer 25 (an undercoat resin layer) which has a refractive index equivalent to that of the condensing lens 21 is formed between the condensing lens 21 and the filter 29 by coating and curing it on the roughened rear side 23, and a buffer layer 26 composed of soft and transparent resin is formed between the filter 29 and the front panel 2 by charging through an adhesive primer. The buffer layer 26 absorbs the thermal stress during use and the residual stress during bonding. Although each of a substrate 17 and terminal pins 12 has a shape different from that of conventional display elements but is equivalent thereto, the shape is not particularly important in the present invention. FIG. 9 is a front view of a case in which red (R) pixels 27R, green (G) pixels 27G and blue (B) pixels 27B are formed in an arrangement comprising 4 lines and 4 columns on the front panel of the emission element (the case 1). The above-described configuration is described in detail below.

The roughened rear side 23 of the condensing lens 21 is first described below. The rear side 23 of the condensing lens 21 is roughened by using sand paper in order to improve the adhesion of the rear side 23 of the condensing lens 21 made of heat resistant acrylic resin. As a method of roughening the rear side 23, a method in which the rear side 23 of the condensing lens 21 is directly roughened by sanding using sand paper, liquid honing or sandblasting is the most effective to improving the adhesion, but a mold for the condensing lens 21 may be roughened. An increase in the adhesion of the roughened rear side 23 of the condensing lens 21 is caused by an increase in the surface area, the attainment of the anchor effect, and an improvement in the wetting properties of the acrylic resin surface, which are all produced owing to the roughening. If an attempt is made to form the resin layer 25 by directly coating and curing an undercoating agent without roughening the rear side 23 of the condensing lens 21, the undercoating agent is repelled and thus the uniform resin layer 25 cannot be formed. The roughness $R_{max}$ of the rear side 23 is preferably 3 to 15 μm.

A description will now be given of the undercoating agent used for forming the resin layer 25. The undercoating agent obtained by dissolving 20% of ultraviolet curing silicone resin (X-62-7509 produced by Shin-etsu Chemical Industry Co., Ltd.) which is the main component of the material for the filter 29 in xylene is spray-coated on the roughened rear side 23, air-dried so that the solvent is removed, and then cured by being irradiated with ultraviolet rays to form the resin layer 25. The filter material is then coated and cured on the cured resin layer 25 to obtain the lens with the filter. The solvent for the undercoating agent is preferably a solvent such as xylene, toluene or the like which are compatible with acrylic resin and liquid silicone resin. The concentration of the undercoating agent is preferably 5 to 70%, more preferably 10 to 40%. Since the undercoating agent contains a solvent (xylene, toluene or the like) which is compatible with acrylic resin, it has good wetting properties for acrylic resin and thus causes the surface of the acrylic resin to slightly dissolve therein. In addition, since the undercoating agent is diluted by the solvent, it has a low viscosity and completely flows into the unevenness of the roughened acrylic resin. These effects cause the formation of the resin layer 25 which is strongly bonded to the acrylic resin. Since the filter material is composed of the same main component as that of the resin layer 25, the filter 29 coated on the resin layer 25 is strongly bonded. If the filter material is coated directly on the roughened acrylic resin surface 23, the filter material incompletely flows into the unevenness because of its higher viscosity than that of the undercoating agent, resulting in the occurrence of a defect. In this case, the filter material also has a low level of adhesion because it has no compatibility with the acrylic resin.

Each of the projections 24 provided on the rear side 23 of the condensing lens 21 has a size of 3 mm in diameter and 0.5 mm in height and so that the distance between the rear side 23 of the condensing lens and the front panel 2 can be set to be as large as possible, and the thickness of the buffer layer 26 charged and cured can be increased. In addition, a curve produced in the condensing lens 21 during the molding of the lens can be removed by precisely adjusting the height of the projections 24. The formation of the buffer layer 26 is lastly described below. A silane coupling agent (Primer A or Primer X-33-144 produced by Shin-etsu Chemical Industry Co., Ltd.) which is an adhesive primer is first coated over the entire surfaces of the filter 29 and the resin layer 25 and the entire surface of the front panel 2 which are opposite to each other. A two-liquid addition reaction-type silicone RTV resin (KE 1603A/B produced by Shin-etsu Chemical Industry Co., Ltd.) is charged between them and cured to form the buffer layer 26 made of soft and transparent resin. The cured product of the two-liquid addition reaction-type silicone RTV resin is colorless, transparent and excellent in light transmittance (95% with a thickness of 1 mm), as well as having a refractive index of 1.50 which is substantially equal to 1.52 of glass, 1.49 of the condensing lens and 1.49 of the filter. Further, since the cured product exhibits flexibility and a high level of elongation (elongation, 400%), it is possible to relieve the thermal stress produced by differences in the coefficients of thermal expansion of the front panel 2, the condensing lens 21 and the filter 29 and sufficiently follow the deformation of the condensing lens 21 caused by an increase in the temperature due to the light emitted from the display tube or the sunlight. In addition, there is substantially no occurrence of discoloration by the light emitted from the emission element in the case 1 or the sunlight or the heat thereof and a low degree of volume shrinkage during the curing. As this resin itself exhibits no adhesion but excellent release properties, it cannot be bonded to a surface to which no silane coupling agent is applied. While this resin exhibits strong adhesion to a surface when a silane coupling agent is applied thereto. It is therefore preferable that no silane coupling agent is applied to portions to which the excess resin should not be adhered when the condensing lens with the filter and the front panel are bonded together. This enables the excess resin to be easily separated after the resin has been cured. In contrary, when the silane coupling agent is applied to not only the upper surface of the front panel 2 of the case 1 but also the external surface of the junction with the outer wall, the resin which overflows when the condensing lens with the filter and the front panel are bonded together strongly adheres to the outer periphery of the connection portion with the front panel and the side wall thereof, whereby the airtightness of the connection portion can be improved, and the glass can be protected from being broken by shocks.

The display element configured as described above showed no abnormalities between the condensing lens 21 and the filter 29 and between the lens with the filter and the front panel 2 in any of the following: 1) a boiling test in boiling water at 100° C. for 2 hours, 2) a low-temperature test at −40° C. for 168 hours, 3) a heat shock test of 400 cycles at −40° C. for 2 hours and 85° C. for 2 hours, 4) a hot-air test in which hot air at 130° C. was blown against the surface of the condensing lens for 1 hour, and 5) a lighting test in an atmosphere at 60° C. When no undercoating agent was applied so that the resin layer 25 was not formed, however, separation occurred between the roughened surface 23 of the condensing lens 21 and the filter 29 in a low-temperature test for 8 hours, a hot-air test for 1 minute and a lighting test for 24 hours. In addition, when the rear side of the condensing lens 21 was not roughened and no undercoating agent was applied, a separation occurred between the condensing lens 21 and the filter 29 in a low-temperature test for 2 hours, a heat shock test in 10 cycles, a hot-air test for 1 minute and a lighting test for 2 hours.

The above-mentioned display element in the second embodiment enables the prevention of separation between the condensing lens and the filter and the case receiving the emission element even if thermal stress or another external force is applied to the display element, as well as the achievement of the effect of preventing the occurrence of an inclination of the condensing lens during connection.

The third embodiment provides a high-quality display element at a low cost which is provided with filter characteristics by being colored so that the filter provided in a conventional display element is made unnecessary and which can be easily produced.

A display element in the third embodiment comprises a colored condensing lens which is provided on the emission surface of one emission element (emission means), in which red, green and blue pixels are respectively formed, for the purpose of condensing the light from each of the pixels. The condensing lens may be uniformly colored so as to have uniform transmission properties for light transmitted therethrough or colored so as to selectively transmit red, green and blue light therethrough. Alternatively, the condensing lens may be colored so that the colors in places corresponding to the respective pixels are different from each other.

The display element in the third embodiment is provided with the colored condensing lens on the emission surface of one emission element so that an image with high luminance and high contrast can be displayed without using the filter provided in a conventional display element. It is therefore possible to realize a high-quality display element at a low cost which can be easily produced. If a lens which is uniformly colored so as to have uniform transmission properties for light transmitted therethrough is used as the colored condensing lens, the intensity of the light emitted from each of the pixels is reduced once when it is transmitted through the condensing lens, while the intensity of external light is reduced twice at the times of incidence and reflection, thereby increasing the contrast between the states of full emission and non-emission.

If a lens which is uniformly colored so as to selectively transmit red, green and blue color therethrough is used as the condensing lens, the condensing lens sufficiently transmits the light from each pixel therethrough, while most of the external light is absorbed twice, thereby increasing the contrast between the states of full emission and non-emission.

Further, if the condensing lens is colored so that the colors in the places corresponding to the respective pixels are different from each other for selectively transmitting the light emitted from the pixels therethrough, the contrast is increased in the same way as in the above-described examples.

Figure 10:
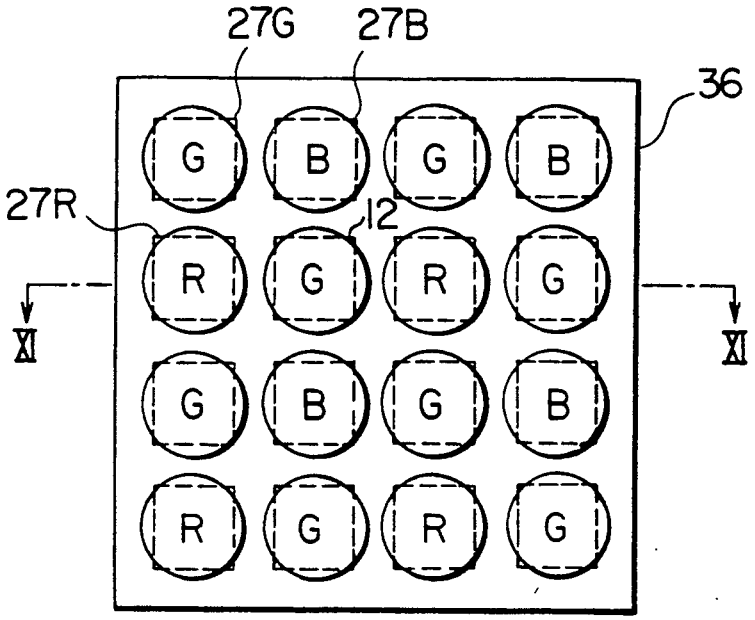
FIG. 10 is a front view of a display element of a third embodiment.
Figure 11:
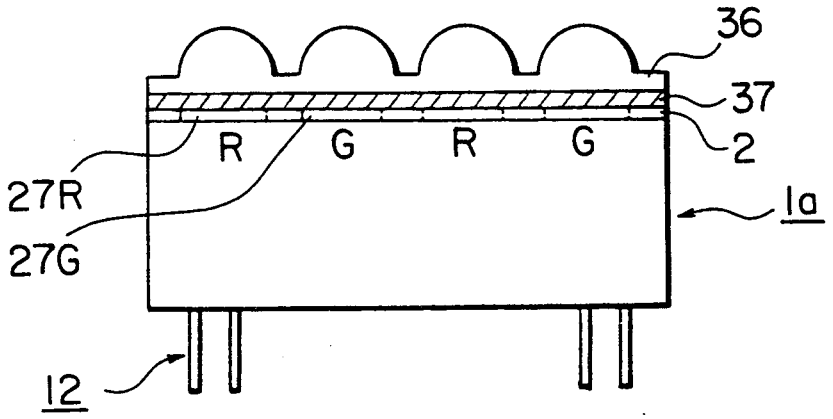
FIG. 11 is a side view of the display element shown in FIG. 10 with a sectional part taken along the line XI—XI in FIG. 10.

The display element of the third embodiment is described below with reference to drawings. FIGS. 10 and 11 are respectively a front view of a display element the third of the embodiment and a side view thereof with a sectional part taken along the line XI—XI in FIG. 10.

In the display element shown in the drawings, red, green and blue pixels 27R, 27G, 27B are formed on the front panel 2 of one emission element 1*a* so that an intended color is displayed on each of the pixels 27R, 27G, 27B by controlling the light emitted from the emission element. A condensing lens 36 is provided in front of the front panel 2 of the emission element 1*a*, the condensing lens 36 and the front panel 2 being bonded together by a transparent adhesive layer 37. The condensing lens 36 is formed by uniformly coloring glass or plastics to an achromatic grey by a dye or pigment so as to have no selective transmission properties but exhibit transmittance which is wholly reduced over the entire region of the visible light. For example, cadmium sulfide, cadmium selenide, iron oxide and chromium oxide may be mixed in a case of glass, and an anthraquinone pigment and phthalocyanine pigment may be mixed in a case of plastics. The transparent adhesive layer 37 is formed by using a silicone, acrylic, epoxy or polyester transparent adhesive so as to sufficiently transmit the light emitted from each of the pixels 27R, 27G, 27B therethrough. The transparent adhesive layer 37 serves to bond the emission element 1*a* to the condensing lens 36 and seal between the emission element 1*a* and the condensing lens 36 so as to prevent a reduction in the amount of the light emitted from the emission element 1*a* owing to a stain produced on the emission surface thereof by dust, particularly rain water and dirt when the display element is used outdoors, which enters between the emission element 1*a* and the condensing lens 36. Further, the use of the transparent adhesive which becomes soft after solidification causes the deformation of the condensing lens 36 produced by thermal stress after bonding to be absorbed by the transparent adhesive layer 37 and thus enables the condensing lens 36 to be prevented from separating from the emission element 1*a*.

The function of each embodiment based on the above-described configuration will be described below with reference to FIG. 11. The color light emitted from each of the red, green and blue sections, i.e., the pixels 27R, 27G and 27B (in FIG. 11, the pixels 27R, 27G), which are arranged in the form of a matrix, is transmitted through the transparent adhesive layer 37 in which the intensity is reduced in accordance with the transmission properties possessed by the color condensing lens 36, and then emitted to the outside. The light, for example, the sunlight, incident on the surface is reduced in intensity in accordance with the transmission properties possessed by the condensing lens 36, transmitted through the transparent adhesive layer 37 and reaches the surface of each of the pixels 27R, 27G, 27B. The light is then reflected from the surface of each of the pixels 27R, 27G, 27B, transmitted through the transparent layer 37 and through the condensing lens 36, in which the intensity is again reduced in accordance with the transmission properties possessed by the condensing lens 36, so as to be condensed, and then emitted to the outside. In other words, in this display element, the intensity of the color light emitted from each of the red, green and blue pixels 27R, 27G, 27B is reduced by the colored condensing lens 36 only once, while the intensity of the light incident on the surface of each of the pixels 27R, 27G, 27B, which is reflected and emitted to the outside, is reduced twice, whereby the luminance of the black color in which no light is emitted from each of the pixels 27R, 27G, 27B is reduced. This causes an increase in the contrast between the states of full emission and non-emission in each of the pixels 27R, 27G, 27B. The light emitted from each of the pixels 27R, 27G, 27B is also condensed in the direction to the front of the display element and colored by the action of the colored condensing lens 36 so that the reduction in the intensity produced when the light is transmitted through the condensing lens 36 is made up for, whereby the luminance in the direction to the front of the display element can be increased.

A description will now be given of a variation further of the embodiment.

In this variation, the colored condensing lens 36 shown in FIGS. 10 and 11 is uniformly colored so as to selectively transmit red, green and blue light therethrough and is made of glass or plastics colored with one kind of dye or pigment or a mixture of several kinds of dyes or pigments. For example, in a case of glass, the condensing lens can be formed by using a mixture of neodymium oxide and chromium oxide. In the second embodiment, the color light emitted from each of the red, green and blue pixels 27R, 27G, 27B is transmitted through the transparent adhesive layer 37 and through the condensing lens 36 and projected to the outside. On the other hand, the light, e.g., the sunlight, incident on the surface, which is reflected therefrom and emitted to the outside, is reduced in intensity in accordance with the transmission properties possessed by the condensing lens 36, is transmitted through the transparent adhesive layer 37 and then reaches the surface of each of the pixels 27R, 27G, 27B. The light is then reflected from the surface of each pixel, transmitted through the transparent adhesive layer 37 and again through the condensing lens 36 in which the intensity is again reduced in accordance with the transmission properties possessed by the condensing lens, so as to be condensed, and then emitted to the outside. That is, in the display element of this embodiment, although the colored condensing lens 36 sufficiently transmits the color light emitted from each of the red, green and blue pixels 27R, 27G, 27B therethrough, it absorbs twice the external light incident upon the surface of each pixel, which is reflected therefrom and emitted to the outside. It is therefore possible to reduce the luminance of black in which no light is emitted from pixels 27R, 27G, 27B in each of the pixels and thus increase the contrast between the states of full emission and non-emission in each of the pixels 27R, 27G, 27B. The light emitted from each of the pixels 27R, 27G, 27B is also condensed in the direction to the front of the display element by the action of the colored condensing lens 36, and the reduction in the intensity produced when the light emitted from each pixel is transmitted through the condensing lens 36 is made up for, thereby increasing the luminance in the direction to the front of the display element.

A description will now be given of a display element in another variation further embodiment of this invention.

In this embodiment, the colored condensing lens 36 shown in FIG. 10 and 11 is colored with dyes which are different in the places corresponding to the respective pixels so as to selectively transmit the light emitted from each of the red, green and blue pixels 27R, 27G, 27B therethrough. The condensing lens 36 is formed of glass or plastics which is colored by dyes so that the cores in the places corresponding to the respective pixels are different from each other.

For example, in a case of glass, the condensing lens can be formed by using a mixture of cadmium sulfide and cadmium selenide in the portions corresponding to the red pixels, iron oxide and chromium oxide in the portions corresponding to the green pixels, and iron oxide and cobalt oxide in the portions corresponding to the blue pixels. In a case of plastics, the condensing lens can be formed by using an anthraquinone pigment in the portions corresponding to the red pixels, a phthalocyanine pigment in the portions corresponding to the green pixels, and a phthalocyanine pigment in the portions corresponding got the blue pixels. The condensing lens 36 can be formed by separately producing the portions corresponding to the pixels and, particularly, in a case of plastics, it can be formed by molding as one unit at a time by using at three-color molding machine. In this embodiment, the color light emitted from each of the red, green and blue pixels 27R, 27G, 27B is transmitted through the transparent adhesive layer 37 and sufficiently transmitted through the condensing lens 36 and then emitted to the outside. On the other hand, the light, e.g., the sunlight, incident on the surface of each of the pixels 27R, 27G, 27B from the outside is reduced in intensity in accordance with the transmission properties possessed by the condensing lens 36, transmitted through the transparent adhesive layer 37 and reaches the surface of each of the pixels 27R, 27G, 27B. The light is then reflected from the surface of each of the pixels 27R, 27G, 27B, transmitted through the transparent adhesive layer 37 and again through the condensing lens 36 in which the intensity is reduced in accordance with the transmission properties possessed by the condensing lens 36, so as to be condensed, and emitted to the outside. Namely, in the display element in this embodiment, the colored condensing lens 36 sufficiently transmits the color light emitted from each of the red, green and blue pixels therethrough, but absorbs twice the light incident on the surface of each pixel from the outside which is reflected therefrom and emitted to the outside. Thus, the luminance of black in which no light is emitted from the pixels is reduced, thereby increasing the contrast between the states of full-emission and non-emission in each of the pixels. The light emitted from each of the pixels is condensed by the action of the colored condensing lens 36 in the direction to the front of the display element so that the reduction in the intensity produced when the color light emitted from each pixel is transmitted through the condensing lens 36 is compensated for, whereby the luminance in the direction to the front of the display element is increased.

Although each of the above-described embodiments of the invention employs as a single element an emission element in the form of a matrix having a pixel number of $4\times4$ therein, the pixel number on the emission element may be $m\times n$ (m and n each denote an integer). This applies to the first and second embodiments of the invention.

As described above, in embodiment, since the colored condensing lens for condensing the light from each pixel is provided on the front panel of an emission element, in which the red, green and blue pixels are formed, it is possible to obtain a high-quality display element at a low cost which has a high level of luminance, which is capable of displaying an image with high contrast and which can be easily manufactured.

The use of the colored condensing lens as a lens which is uniformly colored so as to have uniform transmission properties for light transmitted therethrough causes an increase in the contrast between the states of full-emission and non-emission.

In addition, the use of the condensing lens as a lens which is uniformly colored so as to selectively transmit red, green and blue light therethrough causes an increase in the contrast. If the condensing lens is colored so that the colors in the places corresponding to the respective pixels are different for selectively transmitting the light emitted from the pixels therethrough, the contrast can be increased in the same way as described above.

What is claimed is:

1. A display element comprising:

emission means having a front panel divided into a plurality of pixel units for emitting any one of red, green and blue light and having a side and a side panel, said emission means selectively generating red, green or blue light from each of the units of the front panel;

a filter having a side and comprising a plurality of color filters for said colors disposed in front of said front panel in correspondence with the respective pixel units of said emission means and for transmitting light generated the front panel thereby improving contrast by reducing external light effects;

a condensing lens having a peripheral edge and disposed in front of said filter for condensing light generated by said emission means and transmitted through said filter;

position regulating means disposed along the peripheral edge of said condensing lens, fixed thereto, and extending along the side panel for aligning the side of said front panel of said emission means in substantially the same plane as that of the side of said filter and the peripheral edge of said condensing lens; and transparent adhesive bonding means bonding together said emission means, said filter, said condensing lens and said position regulating means.

2. A display element according to claim 1, wherein said position regulating means comprises a position regulating plate extending along the peripheral edge of said condensing lens, the side of said front panel of said emission means and the side panel of said emission means.

3. A display element according to claim 1, wherein said position regulating means comprises a position regulating plate bent at the peripheral edge of said condensing lens, extending along the side of said condensing lens toward said emission means and is fixed to said condensing lens by an adhesive for regulating the position of the side of said front panel of said emission means in substantially the same plane as the sides of said filter and said condensing lens.

4. A display element according to claim 1, wherein said position regulating means comprises a position regulating plate which extends along the side of said condensing lens toward said emission means and which is formed integrally with said condensing lens for aligning the position of the side of said front panel of said emission means in substantially the same plane as the sides of said filter and said condensing lens.

5. A display element according to claim 1, wherein said filter is mounted on said condensing lens, and said condensing lens and said filter are bonded to said front panel of said emission means by said transparent adhesive.

6. A display element according to claim 5, wherein said filter is bonded to said condensing lens by a transparent adhesive.

7. A display element according to claim 1, wherein said filter is mounted on said front panel of said emission means, and said condensing lens is bonded to said filter by said transparent adhesive.

8. A display element according to claim 7, wherein said filter is bonded to said front panel of said emission means by a transparent adhesive.

9. A method of assembling a display element in which a filter, a condensing lens and a position regulating means are layered on a front panel of an emission means, comprising the steps of:

fixing to said condensing lens said position regulating means which extends along the peripheral edge of said condensing lens toward said emission means; and bonding said condensing lens to which said position regulating means is fixed to said front panel of said emission means with said filter therebetween so that the sides of said condensing lens, said filter and said front panel of said emission means are arranged on substantially the same plane by being pressed by said position regulating means.

10. A display element comprising:

emission means for selectively generating red, green or blue light having a front panel divided into a plurality of pixel units where the red, green and blue light is generated by the pixel units of the front panel and having a side panel;

a condensing lens disposed in front of the front panel of said emission means having a roughened rear side with at least three projections extending from the rear side in contact with the front panel of the emission means defining a given distance between the front panel and the rear side of said condensing lens for improving adhesion;

a resin layer having the same refractive index as that of said condensing lens and disposed on said roughened rear side of said condensing lens by coating and curing;

a filter formed by a coating said resin layer for transmitting the light emitted from said front panel of said emission means and or cutting off external light; and a buffer layer made of transparent resin disposed between said filter and the front panel with an adhesive primer.

11. A display element according to claim 10, wherein the roughness Rmax of said rear side of said condensing lens is 3 to 15 μm.

12. A display element according to claim 10, wherein the projections provided on the rear side of said condensing lens have dimensions which allow said buffer layer to have a large thickness.

13. A method of producing a display element in which a condensing lens, a resin layer, a filter and a buffer layer are provided in front of a front panel of emission means, comprising the steps of:

forming at least three projections on a rear side of the condensing lens made of heat resistant acrylic resin and roughening the rear side by any one of sanding with sandpaper, liquid honing and sand blasting;

forming said resin layer by spray-coating with an undercoating agent of 20% ultraviolet curing silicone resin in xylene solution said roughened rear side of said condensing lens, air-drying the solvent, and drying the agent with ultraviolet light;

forming a filter by coating said resin with layer an undercoating agent containing about 5 to 70% of a solvent which is compatible with acrylic resin and liquid silicon resin and then curing the agent;

mounting the condensing lens on the front panel of the emission means; and forming a soft and transparent buffer layer by coating an adhesive primer over an entire surface of the filter and the resin layer and an entire surface of the front panel of the emission means, which are opposite to each other; and inserting two-liquid addition reaction-type silicon RTV resin between the filter and the front panel and then curing the resin.

14. A method of producing a display element according to claim 13, wherein the solvent for the undercoating agent used for forming the filter is one of xylene and toluene.

15. A method of producing a display element according to claim 14, wherein the concentration of xylene or toluene in the undercoating agent is 10 to 40%.

* * * * *